United States Patent [19]

Bahia

[11] Patent Number: 4,902,562

[45] Date of Patent: Feb. 20, 1990

[54] ELECTRICALLY CONDUCTIVE MATERIALS

[75] Inventor: Hardev S. Bahia, Coventry, United Kingdom

[73] Assignee: Courtaulds PLC, United Kingdom

[21] Appl. No.: 216,112

[22] Filed: Jul. 7, 1988

[30] Foreign Application Priority Data

Jul. 9, 1987 [GB] United Kingdom ..... 8716199

[51] Int. Cl.[4] ..... B02B 5/16

[52] U.S. Cl. ..... 428/283; 252/500; 428/224; 428/240; 428/244; 428/290; 428/922

[58] Field of Search ..... 252/500; 428/283, 408, 428/244, 290, 242, 240, 922, 224

[56] References Cited

U.S. PATENT DOCUMENTS 2,845,962 8/1958 Bulgin ..... 139/420

3,755,519 8/1973 Meyers et al. ..... 264/26

FOREIGN PATENT DOCUMENTS 0240720 11/1985 Japan .

1333594 10/1973 United Kingdom .

1443336 7/1976 United Kingdom .

OTHER PUBLICATIONS

Derwent Abstract 85-058430/10 (Jan. 24, 1985).

*Primary Examiner*—James J. Bell

*Attorney, Agent, or Firm*—Howson & Howson

[57] ABSTRACT

Filled polymer material, which is either textile material comprising filaments of a fibre-forming polymer filled with a particulate conductive material or sheet material of a polymer filled with a particulate conductive material, treated with an organic liquid to increase its electrical conductivity.

19 Claims, No Drawings

ELECTRICALLY CONDUCTIVE MATERIALS

This invention relates to electrically conductive, filled polymer materials, particularly textile materials and sheet materials such as films, sheets or tapes cut from sheets. By a textile material we mean a fabric, which can be woven, knitted or non-woven fabric, yarn, tow, fibres or filaments. Electrically conductive textile materials can be formed from filaments filled with an electrically conductive filler such as carbon black. They are used when a high performance anti-static fabric is required, for example for upholstery and floor coverings in rooms where any electrical discharge must be avoided, for example in computer rooms, places where electronic equipment is manufactured or inspected or places where there is an explosion risk from static electricity. Electrically conductive films, strips or tapes can be formed from a polymer composition filled with an electrically conductive filler such as carbon black and are used for example for covering or packaging electronic components.

The maximum loading of carbon black in a fibre-forming polymer which can be spun to form filaments is about 35 per cent by weight. A fabric formed from such filaments generally has a surface resistivity greater than $10^4$ ohms per unit square. In upholstery fabrics the yarns of carbon-filled filaments are generally used with other yarns to avoid a plain black fabric. The surface resistivity of such mixed fabrics is generally $3\times10^4$ to $5\times10^4$ ohms per unit square. For some uses a lower surface resistivity is desired.

A process according to the invention for producing an electrically conductive textile material or sheet material comprising a polymer filled with a particulate conductive material is characterised in that a textile material comprising filaments of a fibre-forming polymer filled with a particulate conductive material or sheet material of a polymer filled with a particulate conductive material is treated with an organic liquid to increase its electrical conductivity.

The conductive filler is preferably carbon black, although other particulate conductive materials such as metal powders can be used. The polymer preferably contains 20–35 per cent by weight (about 10 to 22 per cent by volume) carbon black, especially 25 to 33 per cent by weight. The particle size of the carbon black is usually in the range 0.5–10 nm.

Electrically conductive textile material according to a preferred embodiment of the invention comprising filaments of a fibre-forming polymer filled with 10 to 22 per cent by volume of a conductive filler is characterised in that the filaments have a modified surface produced by treating the textile material with an organic liquid to increase its conductivity.

The filaments are preferably formed by melt spinning a fibre-forming thermoplastic polymer. The polymer can for example be a polyolefin such as polypropylene or polyethylene, a polyester such a polyethylene terephthalate, a polyamide or a vinyl polymer such as polyvinyl chloride. Polypropylene filaments are preferred.

Electrically conductive polymer sheet material according to a preferred embodiment of the invention comprises a polymer filled with 10 to 22 per cent by volume of a conductive filler and having a modified surface produced by treating the sheet material with an organic liquid to increase its conductivity.

The organic liquid used to treat the textile material or sheet material is preferably a hydrocarbon, a halogenated hydrocarbon, an ether, a ketone or an alcohol. For materials formed from polyolefin, for example textile materials formed from polypropylene fibres, a hydrocarbon or halogenated hydrocarbon is preferred such as xylene, toluene, petroleum ether, trichloroethylene or perchloroethylene or carbon tetrachloride.

The textile material which is treated with the organic liquid is preferably a fabric. The fabric is preferably immersed in the organic liquid for a period of 0.1 to 120 minutes, for example 1 to 60 minutes, preferably 1 to 20 minutes. Treatment at ambient temperature (in the range 10 to 30° C.) is generally sufficient, although higher temperature can be used, for example treatment can be carried out at up to 100° C. or treatment at ambient temperature can be followed by heating at up to 100° C. The treatment can be carried out in apparatus conventionally used for dry cleaning fabrics and garments. Alternatively a continuous length of fabric can be passed through a treatment bath, particularly if such immersion is followed by heating in an oven. The textile material can alternatively be a yarn or tow, which can be treated using apparatus designed for dyeing yarn or tow, but fabric treatment is more convenient. An upholstery fabric can for example be treated in fabric form before it is applied to furniture for a computer room.

A film, sheet or tape can also be immersed for 0.1 to 120 minutes, for example by passing through a treatment bath, preferably followed by heating.

The organic liquid treatment generally decreases the surface resistivity of the fabric by a factor of 5 to 15. For example, a fabric comprising 50 to 75 per cent by weight of conductive, for example carbon-filled, filaments having a surface resistivity of $3\times10^4$ to $5\times10^4$ ohms per unit square can have its surface resistivity reduced to below $10^4$ ohms, for example $1\times10^3$ ohms to $6\times10^3$ ohms, per unit square. We believe that the organic liquid treatment affects the surface of the conductive filaments; the resistance of the conductive yarn in the fabric is reduced by a similar factor.

The solvent treatment gives a small weight loss (usually 5 to 15 per cent) but prolonged immersion in the solvents does not lead to further weight loss.

The fabric which is treated may consist entirely of yarns of the filaments filled with conductive material but preferably includes other yarns or fibres not filled with a conductive filler so that the fabric can be patterned. Such other yarns or fibres can be any of those known for producing textile fabrics, for example polyester, wool, cotton, regenerated cellulose, acrylic or polyolefin fibres. The fabric is preferably treated with the organic liquid after any other finishing treatments, for example scouring, heating on a stenter and dyeing, if required, have been carried out. The treatment with the organic liquid generally causes some shrinkage of the fabric, for example by 5 to 10 per cent for a fabric which has not been stentered or 2 to 5 percent for a fabric which has been stentered.

The invention is illustrated by the following Examples:

EXAMPLE 1

Polypropylene containing 30 per cent by weight carbon black (Cabelec 3140 sold by Cabot) and 0.7 per cent lubricant was melt spun to form a 1200 decitex/30 filament conductive yarn. This yarn was folded at a hundred turns per meter with a two-fold 32s worsted count (555 decitex) 45 per cent wool/55 per cent polyester yarn. The composite yarn so folded was woven into a plain weave fabric at 9.1 ends per centimeter and 7.7 picks per centimeter. The surface resistivity of the fabric was measured using a device having two vermason electrodes 7.5 centimeters long and 7.5 centimeters apart with a 4.5 kilogramme weight to press down on the fabric. The surface resistivity wa $3\times10^4$ohms per unit square.

The fabric was then treated with trichloroethylene in a dry cleaning machine at ambient temperature for 10 minutes. The surface resistivity of fabric after treatment was $3.5\times10^3$ohms per unit square. The fabric shrank by about 8 per cent in each direction during the trichloroethylene treatment.

EXAMPLES 2 to 8

The conductive yarn described in Example 1 was woven into a plain weave fabric at 12.8 ends per cm and 10.2 picks per cm in the finished fabric (weight 319 grams/sq. meter). Samples cut from the fabric were soaked for 1 hour at room temperature in a range of solvents then dried at room temperature. The results are shown in Table 1.

TABLE 1

| Example No. | Solvent Type | Surface Resistivity Ohms/sq. |
|---|---|---|
| 2 | Original | $16.5\times10^3$ |
| 3 | Diethyl ether | $2.3\times10^3$ |
| 4 | Butanol | $5.1\times10^3$ |
| 5 | Methyl Ethyl Ketone | $6.4\times10^3$ |
| 6 | Trichloroethylene | $1.4\times10^3$ |
| 7 | Xylene | $1.9\times10^3$ |
| 8 | Toluene | $1.2\times10^3$ |
| 9 | Perchloroethylene | $1.2\times10^3$ |

Treatment with inorganic materials such as concentrated mineral acids gave no significant decrease in resistivity.

EXAMPLES 9 to 19

Further samples of the fabric used in Example 2 were soaked in perchloroethylene for different lengths of time and then dried in the oven at 50° C. for 20 minutes. The results are shown in Table 2.

TABLE 2

| Example No. | Time of Soak (mins) | % Wt. Loss | % Area Shrinkage | Surface Resistivity ohms/sq |
|---|---|---|---|---|
| | 0 | — | — | $16.5\times10^3$ |
| 9 | 2 | 6.3 | 11.6 | $2.62\times10^3$ |
| 10 | 5 | 6.8 | 10.1 | $2.23\times10^3$ |
| 11 | 10 | 6.9 | 11.4 | $1.66\times10^3$ |
| 12 | 15 | 7.9 | 11.2 | $1.37\times10^3$ |
| 13 | 30 | 8.6 | 12.2 | $1.03\times10^3$ |
| 14 | 45 | 9.2 | 13.0 | $0.92\times10^3$ |
| 15 | 60 | 9.2 | 12.0 | $0.88\times10^3$ |
| 16 | 120 | 10.1 | 13.4 | $0.82\times10^3$ |
| 17 | 180 | 10.5 | 13.9 | $0.74\times10^3$ |
| 18 | 720 | 11.3 | 14.1 | $0.84\times10^3$ |
| 19 | 1440 | 11.3 | 14.5 | $0.83\times10^3$ |

The results show a somewhat steady figure in terms of resistivity and of weight loss is achieved after 2 hours' soak in the perchloroethylene.

EXAMPLES 20 to 23

Further samples of the fabric used in Example 2 were soaked in perchloroethylene at room temperature for five minutes and then dried in an oven for 20 minutes, at a range of temperature as shown in Table 3.

TABLE 3

| Example No. | Oven Temperature (°C.) | % Wt. Loss | % Area Shrinkage | Surface Resistivity ohms/sq |
|---|---|---|---|---|
| 20 | 25 | 5.6 | 1.9 | $2.00\times10^3$ |
| 21 | 50 | 6.3 | 8.3 | $1.68\times10^3$ |
| 22 | 75 | 6.8 | 10.8 | $1.85\times10^3$ |
| 23 | 100 | 6.1 | 12.1 | $1.51\times10^3$ |

EXAMPLES 24 to 27

Further samples of the fabric were soaked in perchloroethylene at a range of temperatures. The time of soak of each sample was 15 minutes. The samples were dried in the oven for 20 minutes at 75° C. The results are shown in Table 4.

TABLE 4

| Example No. | Temperature Of Solvent (°C.) | % Wt. Loss | % Area Shrinkage | Surface Resistivity Ohms/sq |
|---|---|---|---|---|
| 24 | 20 | 8.7 | 12.8 | $1.11\times10^3$ |
| 25 | 40 | 9.6 | 12.1 | $0.88\times10^3$ |
| 26 | 60 | 11.9 | 19.2 | $0.78\times10^3$ |
| 27 | 80 | 12.5 | 27.9 | $0.66\times10^3$ |

EXAMPLE 18

AFTER TREATMENT

In order to find whether the change in resistivity value after treatment with perchloroethylene is stable or not, one sample (A) of the fabric mentioned in Example 2 was treated with perchloroethylene at room temperature for 1 hour and then washed using normal detergents. Another sample (B) of the same fabric was treated with perchloroethylene in the same manner and then kept in an oven at 95° C. for 4 weeks. The results are shown in Table 5.

TABLE 5

| Samples measured | Surface Resistivity Ohms/sq |
|---|---|
| Original samples A and B | 16500 |
| Sample A after treatment with perchloroethylene | 800 |
| Sample A after washing | 960 |
| Sample B after treatment with perchloroethylene | 715 |
| Sample B after being left in oven for 4 weeks at 95° C. | 593 |

Thus it can be concluded that the perchloroethylene-treated samples had not lost any substantial part of their improved resistivity value either after washing or prolonged heat treatment.

What is claimed is:

1. A process for increasing the electrical conductivity of a filled polymer material selected from the group consisting of a textile material comprising filaments of a fibre-forming polymer filled with a particulate conductive material or sheet material of a polymer filled with a particulate conductive material, said process comprising treating said filled polymer material with an organic liquid to increase the electrical conductivity of the filled polymer material.

2. A process according to claim 1 in which said organic liquid is selected from the group consisting of hydrocarbons, halogenated hydrocarbons, ethers, ketones, and alcohols.

3. A process according to claim 1 in which said polymer is a polyolefin.

4. A process according to claim 3 in which the organic liquid used to treat the filled polymer material is a hydrocarbon.

5. A process according to claim 3 in which the organic liquid used to treat the filled polymer material is a halogenated hydrocarbon.

6. A process according to claim 5 in which said halogenated hydrocarbon is trichloroethylene.

7. A process according to claim 5 in which said halogenated hydrocarbon is perchloroethylene.

8. A process according to claim 1 in which said filled polymer material is immersed in said organic liquid for 0.1 to 120 minutes at a temperature in the range 10° to 100° C.

9. A process according to claim 8 in which said filled polymer material is initially immersed in said organic liquid at a temperature in the range 10 to 30° C. and is subsequently heated at a higher temperature up to 100° C.

10. The process according to claim 1 wherein said particulate conductive material is carbon black.

11. The process according to claim 1 wherein said fibreforming polymer is polypropylene.

12. Electrically conductive textile material comprising filaments of a fibre-forming polymer filled with 10 to 22% by volume of a conductive filler, said filaments having a modified surface produced by treating said textile material with an organic liquid to increase its conductivity.

13. Electrically conductive textile material according to claim 12 in which said conductive filler is carbon black.

14. Electrically conductive textile material according to claim 12 consisting of a fabric comprising yarns or filaments filled with said conductive filler.

15. Electrically conductive textile material according to claim 14 in which said fabric includes yarns not filled with conductive filler.

16. Electrically conductive textile material according to claim 12 in which said fibre-forming polymer is polypropylene.

17. Electrically conductive polymer sheet material comprising a polymer filled with 10–22% by volume of a conductive filler, said polymer sheet material having a modified surface produced by treating said sheet material with an organic liquid to increase its conductivity.

18. Electrically conductive polymer sheet material according to claim 17 in which said conductive filler is carbon black.

19. Electrically conductive polymer sheet material according to claim 17 in which said polymer is polypropylene.

* * * * *